US007563215B1

(12) United States Patent
Ross, Jr.

(10) Patent No.: US 7,563,215 B1
(45) Date of Patent: Jul. 21, 2009

(54) ABDOMINAL MUSCLE STANDING EXERCISER

(76) Inventor: Raymond Ross, Jr., 800 Park Ave., Fairfield, AL (US) 35064

( * ) Notice: Subject to any disclaimer, the term of this patent is extended or adjusted under 35 U.S.C. 154(b) by 336 days.

(21) Appl. No.: 11/297,569

(22) Filed: Dec. 8, 2005

(51) Int. Cl.
*A63B 26/00* (2006.01)
*A63B 23/00* (2006.01)

(52) U.S. Cl. ..... 482/140; 482/148

(58) Field of Classification Search ..... 482/140, 482/121–123, 130, 14–15
See application file for complete search history.

(56) References Cited

U.S. PATENT DOCUMENTS 1,705,745 A * 3/1929 Anderson ..... 482/123
5,441,473 A * 8/1995 Safani et al. ..... 482/130
6,022,303 A 2/2000 Abdo
6,280,367 B1 * 8/2001 Arsenault ..... 482/140
6,309,330 B1 * 10/2001 Thornton ..... 482/140
6,699,162 B2 * 3/2004 Chen ..... 482/140
6,939,277 B2 9/2005 Tuller et al.
7,070,548 B2 * 7/2006 Thonn, Jr. ..... 482/142
7,101,328 B2 * 9/2006 Chiu ..... 482/140
7,137,937 B2 * 11/2006 Croft ..... 482/142
2004/0097351 A1 5/2004 Tornabene

* cited by examiner

*Primary Examiner*—Fenn C Mathew
(74) *Attorney, Agent, or Firm*—Kenneth M. Bush; Gerald M. Walsh; Bush Intellectual Property Law

(57) ABSTRACT

An abdominal muscle exercise device which facilitates exercising and training of abdominal and lower back muscles while in a standing position. The exercise device has a platform with vertical members at the back of the platform. A horizontal member is attached at the top ends of the vertical members. The vertical members have an angled member extending away from the platform to prevent the platform from tipping during use. The vertical members can be removably and/or foldably connected to the platform and can be adjustable in height. The angled members can be removably and/or foldably connected to the vertical members and can be adjustable in length. The exercise device is constructed so that a user can stand on the platform and bend backwards over the horizontal member to exercise the abdominal and lower back muscles. Exercising these muscles in this standing position minimizes the stress encountered by the spine during abdominal exercising, and concentrates the stress on the abdominal muscles.

6 Claims, 3 Drawing Sheets

ABDOMINAL MUSCLE STANDING EXERCISER

BACKGROUND OF THE INVENTION

1. Field of the Invention

The present invention relates to abdominal exercise devices and, more particularly, to abdominal exercise devices that facilitate exercising abdominal muscles and lower back muscles from a standing position.

2. Technical Background

The importance of exercising the abdominal muscles is well established, and devices for exercising these muscles are known in the art. Most of these devices operate with the user in a sitting position or while inclined or laying down.

Properly strengthened abdominal and lower back muscles are necessary for maintaining normal flexibility and curvature of the spine, especially during aging. These muscles provide support for many body movements, particularly in the standing position. These body movements include swaying, pivoting, rocking, twisting, and bending. Thus, the integrity and strength of the frontal abdominal, the external oblique, and the lower back muscles are imperative to leading a physically active life. Proper exercising of the abdominal and lower back muscles improves total flexibility of the spine and helps maintain normal spinal curvature, thereby reducing the likelihood of low back injury and pain.

Most abdominal muscle exercise devices are designed for use in a sitting or inclined position. This approach to exercising the abdominal and lower back muscles may create undue strain on the lumbar spinal discs and the lower back muscles. The proper strengthening and training of the abdominal and lower back muscles requires proper balancing of the intensity and stress among these muscles. This is best achieved by exercising the abdominal and lower back muscles while in a standing position which minimizes undue strain on the spine and lower back muscles. What is needed, therefore, is a device which will facilitate exercising and training abdominal and lower back muscles while in a standing position.

SUMMARY OF THE INVENTION

The present invention is an abdominal exercise device which facilitates exercising and training of abdominal and lower back muscles while in a standing position. The device has a platform with one or more vertical members that support a horizontal member. The vertical members have angled members that extend in front of the platform to prevent it from tipping during use. A user stands on the platform and bends backwards over the horizontal member to exercise the abdominal and lower back muscles. By exercising the abdominal and lower back muscles in the standing position the user can simulate and intensify the normal stresses encountered by the abdominal and lower back muscles in maintaining posture and moving the body. In addition, exercising these muscles in the standing position minimizes the stress encountered by the spine during abdominal exercising, while focusing the stress on the abdominal muscles.

An advantage of the present invention is an abdominal exerciser that allows a user to exercise and train the abdominal muscles while standing.

Another advantage is an abdominal exerciser that minimizes stress on the spine while exercising the abdominal and lower back muscles, and concentrates the stress on the abdominal muscles.

Another advantage is an abdominal exerciser that is adjustable, foldable, and portable.

Another advantage is an abdominal exerciser that is simple and inexpensive to construct.

DETAILED DESCRIPTION OF THE INVENTION

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
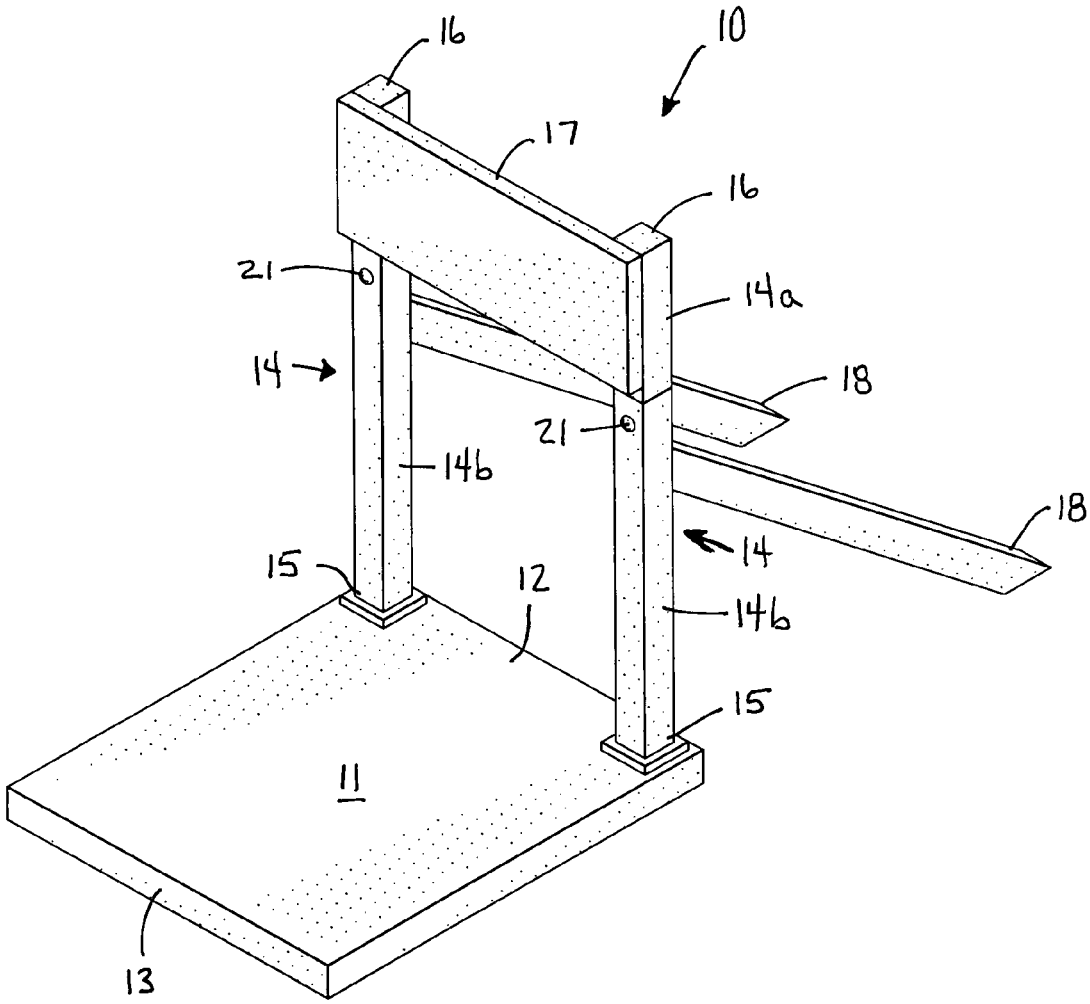
FIG. 1 shows a perspective view of the abdominal muscle exerciser of the present invention.

FIG. 1 shows a left rear perspective view of the abdominal muscle exerciser 10 of the present invention. Exerciser 10 has a platform 11 with a front end 13 and a back end 12. One or more vertical members 14 are attached to back end 12 of platform 11 at the bottom end 15 of vertical member 14. A horizontal member 17 is attached at top ends 16 of vertical members 14. Vertical members 14 have angled members 18 which extend away from platform 11 opposite back end 12 of platform 11. Vertical members 14 can be adjustable in height, and angled members 18 can be adjustable in length. Vertical members 14 can be reversibly and/or foldably attached to platform 11, and angled members can be reversibly and/or foldably attached to vertical members 14. Abdominal muscle exerciser 10 can be constructed of plastic, metal, wood, or a combination thereof.

In the preferred embodiment, vertical members 14 each comprise an upper portion 14*a* and a lower portion 14*b*, wherein the horizontal member 17 is attached to the upper portion 14*a*. The upper portion 14*a* has a lower end having a reduced diameter and a plurality of transverse holes therethrough and the lower portion 14*b* is at least partially hollow for receiving the reduced diameter lower end of the upper portion 14*a*. The lower portion 14*b* has a hole therethrough such that a securing pin 21 can be inserted through the hole in the lower portion 14*b* and through one of the holes in the reduced diameter lower end of the upper portion 14*a* to secure the horizontal member 17 at selected heights. This type of telescoping feature is well known in the art of exercise equipment.

Figure 2:
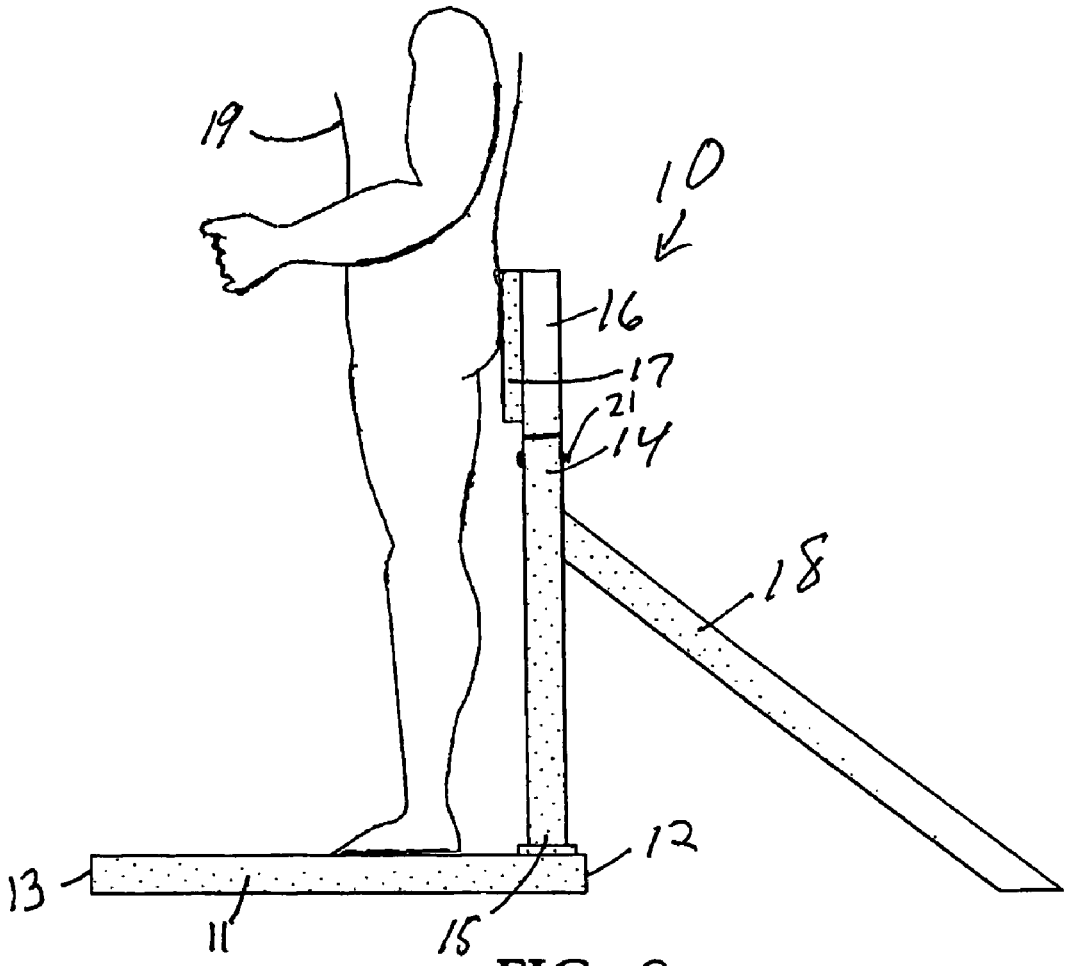
FIG. 2 shows a user in a standing, upright position on the abdominal muscle exerciser.
Figure 3:
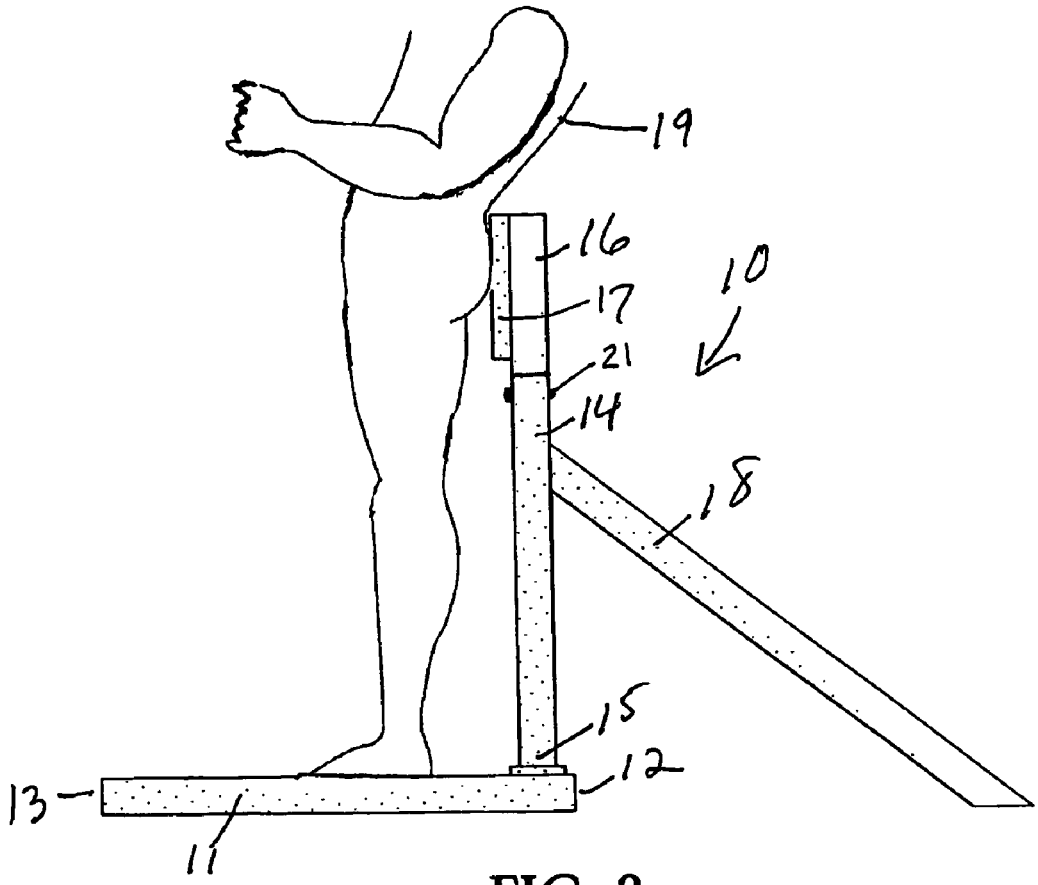
FIG. 3 shows a user in a standing, bent over backwards position on the abdominal muscle exerciser.

FIG. 2 shows a user 19 standing on platform 11 in front of the horizontal member 17. FIG. 3 shows the user 19 bending backwards over the horizontal member 17 to exercise the abdominal and lower back muscles. Angled members 18 extend outward and downward to the surface upon which platform 11 rests. Angled members 18 prevent platform 11 from tipping backwards as user 19 bends backwards over horizontal member 17. The preferred method of using the abdominal muscle exerciser 10 is to move from the position shown in FIG. 2 to the position shown in FIG. 3 and back to the position shown in FIG. 1 within about 1 second, with as many repetitions as desired. Exercising the abdominal muscles in this manner focuses most of the stress movements on the abdominal muscles and minimizes stress on the spine. The lower back muscles are also exercised in the process.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, a user can also use the abdominal muscle exerciser 10 of the present invention to exercise the external oblique muscles by bending sideways over the horizontal member 17. Exerciser 10 can be constructed in various sizes and shapes as desired, and can be portable.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A method of exercising the abdominal muscles of a person in a standing position, comprising the steps of:

1) standing on a platform in a vertical position with the buttocks of the person supported against a horizontal support member;
2) leaning backward so that the back of the person is angled over said horizontal support member;
3) returning to said vertical position; and
4) repeating steps 2 and 3;
5) wherein said method is performed on an abdominal muscle exercise device, comprising:
   a) a platform having a bottom for resting on a support surface, a top for supporting a user, a front end, a back end, a first side, and a second side;
   b) a first vertical support member having a top end and a bottom end, wherein said bottom end of said first vertical support member is secured adjacent to said back end of said platform and adjacent to said first side of said platform;
   c) a second vertical support member having a top end and a bottom end, wherein said bottom end of said second vertical support member is secured adjacent to said back end of said platform and adjacent to said second side of said platform;
   d) a horizontal support member attached at a first end to said top end of said first vertical support member and at a second end to said top end of said second vertical support member, wherein said horizontal support member is located at a height to engage the buttocks of the user in a standing position;
   e) a first angled support member secured at an upper end to said first vertical support member, wherein a lower end of said first angled support member is designed to rest on the support surface; and
   f) a second angled support member secured at an upper end to said second vertical support member, wherein a lower end of said second angled support member is designed to rest on the support surface.

2. A method according to claim 1, wherein said first and second vertical support members are telescoping.

3. A method according to claim 1, wherein said first and second angled support members are telescoping.

4. A method of exercising the abdominal muscles of a person in a standing position, comprising the steps of:

a) standing on a platform in a vertical position with the buttocks of the person supported against a horizontal support member;
b) leaning backward so that the back of the person is angled over said horizontal support member;
c) returning to said vertical position; and
d) repeating steps b and c;
e) wherein said method is performed on an abdominal muscle exercise device, consisting of:
   i) a platform having a bottom for resting on a support surface, a top for supporting a user, a front end, a back end, a first side, and a second side;
   ii) a first vertical support member having a top end and a bottom end, wherein said bottom end of said first vertical support member is secured adjacent to said back end of said platform and adjacent to said first side of said platform;
   iii) a second vertical support member having a top end and a bottom end, wherein said bottom end of said second vertical support member is secured adjacent to said back end of said platform and adjacent to said second side of said platform;
   iv) a horizontal support member attached at a first end to said top end of said first vertical support member and at a second end to said top end of said second vertical support member, wherein said horizontal support member is located at a height to engage the buttocks of the user in a standing position;
   v) a first angled support member secured at an upper end to said first vertical support member, wherein a lower end of said first angled support member is designed to rest on the support surface; and
   vi) a second angled support member secured at an upper end to said second vertical support member, wherein a lower end of said second angled support member is designed to rest on the support surface.

5. A method according to claim 4, wherein said first and second vertical support members are telescoping.

6. A method according to claim 4, wherein said first and second angled support members are telescoping.

* * * * *